US011339041B2

(12) United States Patent
Gales

(10) Patent No.: US 11,339,041 B2
(45) Date of Patent: May 24, 2022

(54) POWER LIFT

(71) Applicant: Clark Equipment Company, West Fargo, ND (US)

(72) Inventor: Nicolas Gales, Pouldreuzic (FR)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 133 days.

(21) Appl. No.: 16/323,040

(22) PCT Filed: Aug. 29, 2017

(86) PCT No.: PCT/US2017/049090
§ 371 (c)(1),
(2) Date: Feb. 4, 2019

(87) PCT Pub. No.: WO2018/044871
PCT Pub. Date: Mar. 8, 2018

(65) Prior Publication Data

US 2019/0169009 A1 Jun. 6, 2019

Related U.S. Application Data

(60) Provisional application No. 62/381,253, filed on Aug. 30, 2016.

(51) Int. Cl.
*B66F 9/22* (2006.01)
*E02F 3/43* (2006.01)
(Continued)

(52) U.S. Cl.
CPC ..... *B66F 9/22* (2013.01); *B66F 9/0655* (2013.01); *E02F 3/433* (2013.01); *E02F 3/436* (2013.01);
(Continued)

(58) Field of Classification Search
CPC .. B66F 9/22; B66F 9/0655; B66F 7/22; E02F 9/2029; E02F 3/433; E02F 3/436;
(Continued)

(56) References Cited

U.S. PATENT DOCUMENTS 2,986,294 A * 5/1961 Granryd ..... E02F 3/401 414/699
2,990,072 A * 6/1961 Mindrum ..... B66F 9/0655 414/708
(Continued)

FOREIGN PATENT DOCUMENTS

EP 0172524 A2 2/1986
EP 1600419 A1 11/2005
GB 821746 A 10/1959

OTHER PUBLICATIONS

International Search Report and Written Opinion dated Nov. 23, 2017 for International Application No. PCT/US2017/049090 filed Aug. 29, 2017, 10 pages.
(Continued)

*Primary Examiner* — Robert F Long
(74) *Attorney, Agent, or Firm* — John Veldhuis-Kroeze; Westman, Champlin & Koehler, P.A.

(57) ABSTRACT

Power machines and control systems used thereon include a lift cylinder, a tilt cylinder, and a slave cylinder mechanically connected to assist the lift cylinder with raising a boom. With a lift control valve controlled to cause extension of the lift cylinder to raise the boom, pressure from a hydraulic source is provided to the slave cylinder to aid in raising the boom. Resulting increased pressure on a side of the slave cylinder opens load holding valves, allowing hydraulic pressure from the tilt cylinder to be communicated to the slave cylinder such that tilt cylinder pressure due to a heavy load on an implement aids in raising the boom.

15 Claims, 3 Drawing Sheets

(51) Int. Cl.
*E02F 9/20* (2006.01)
*B66F 9/065* (2006.01)
*E02F 9/22* (2006.01)

(52) U.S. Cl.
CPC ..... *E02F 9/2029* (2013.01); *E02F 9/2041* (2013.01); *E02F 3/432* (2013.01); *E02F 9/2225* (2013.01); *F15B 2211/30515* (2013.01); *F15B 2211/30585* (2013.01); *F15B 2211/30595* (2013.01); *F15B 2211/3111* (2013.01); *F15B 2211/50518* (2013.01); *F15B 2211/50545* (2013.01); *F15B 2211/50554* (2013.01); *F15B 2211/50581* (2013.01); *F15B 2211/5153* (2013.01); *F15B 2211/5156* (2013.01); *F15B 2211/7128* (2013.01); *F15B 2211/7142* (2013.01)

(58) Field of Classification Search
CPC ..... E02F 9/2041; E02F 3/432; E02F 9/2225; F15B 2211/30515; F15B 2211/30585; F15B 2211/30595; F15B 2211/3111; F15B 2211/50518; F15B 2211/50545; F15B 2211/50581; F15B 2211/5153; F15B 2211/5156; F15B 2211/7128; F15B 2211/7142; F15B 2211/50554; E21B 7/00
USPC ..... 173/184–185, 93
See application file for complete search history.

(56) References Cited

U.S. PATENT DOCUMENTS 3,401,514 A * 9/1968 Clark ..... A01D 46/24 56/328.1
3,487,968 A * 1/1970 Long ..... E02F 3/433 414/701
3,722,723 A * 3/1973 Matthews ..... B66F 9/22 414/636
3,754,394 A * 8/1973 Morrison ..... F15B 11/17 60/484
3,836,025 A * 9/1974 Olson ..... B66F 9/0655 414/547
3,860,088 A * 1/1975 Gellatly ..... B66F 11/046 182/2.3
4,037,671 A 7/1977 Kimber et al.
4,130,168 A * 12/1978 Deike ..... E21B 7/022 173/141
4,382,743 A * 5/1983 Newell ..... B66F 9/122 212/231
4,456,093 A * 6/1984 Finley ..... B66F 17/006 182/18
4,722,044 A * 1/1988 Heiser ..... E02F 9/2037 414/700
4,738,581 A * 4/1988 Kuhlman ..... A61G 3/0209 224/492
4,798,512 A * 1/1989 Intveld ..... E02F 3/3411 414/697
4,801,126 A * 1/1989 Rosman ..... B66C 13/18 254/386
4,923,362 A * 5/1990 Fryk ..... E02F 3/433 414/700
4,964,780 A * 10/1990 Karvonen ..... B66F 9/0655 414/718
5,285,020 A * 2/1994 Jurca ..... G01G 19/10 177/139
5,471,839 A * 12/1995 Hirata ..... F15B 13/06 60/484
2001/0015129 A1* 8/2001 Altman ..... B66F 9/22 91/525
2002/0042324 A1* 4/2002 Agner ..... F16D 48/02 477/37
2006/0213676 A1* 9/2006 Jinnings ..... E02D 7/10 173/184
2008/0190633 A1* 8/2008 Johnston ..... E02F 3/06 173/184
2010/0012340 A1* 1/2010 Kuosmanen ..... E21B 7/023 173/184
2011/0100659 A1* 5/2011 Murate ..... E02D 7/20 173/104
2014/0037415 A1* 2/2014 Zuritis ..... E02F 3/42 414/695.5
2014/0107897 A1* 4/2014 Zhu ..... E02F 9/2025 701/50
2014/0182279 A1* 7/2014 Wu ..... E02F 9/2091 60/327
2014/0208575 A1* 7/2014 Jagdale ..... E02F 3/966 29/525.02
2014/0360349 A1* 12/2014 De Gier ..... E02F 3/965 91/166
2015/0292526 A1* 10/2015 Saitoh ..... E02F 9/2285 60/477
2016/0002889 A1* 1/2016 Kajita ..... F04B 49/08 701/50
2016/0138240 A1* 5/2016 Ikegami ..... E02F 9/2225 701/50
2016/0265187 A1* 9/2016 Baba ..... E02F 3/435
2016/0333900 A1* 11/2016 Takahashi ..... F15B 11/161
2018/0119492 A1* 5/2018 Nelson ..... E21D 20/003
2019/0071843 A1* 3/2019 Ohlsson ..... E02F 9/02
2019/0071844 A1* 3/2019 Ohlsson ..... E02F 9/0841
2019/0093373 A1* 3/2019 Telleria ..... B05B 13/0431
2020/0199842 A1* 6/2020 Nakajima ..... E02F 9/2292
2020/0269439 A1* 8/2020 Telleria ..... B25J 11/005
2021/0010239 A1* 1/2021 Ono ..... E02F 9/2282
2021/0095701 A1* 4/2021 Brabec ..... F15B 13/043
2021/0115643 A1* 4/2021 Tanaka ..... E02F 9/2029
2021/0262201 A1* 8/2021 Saitoh ..... E02F 9/2296

OTHER PUBLICATIONS

First Office Action, including search report, for Chinese Patent Application No. 201780052455.X, dated Jan. 4, 2021, 10 pages.

* cited by examiner

POWER LIFT

CROSS-REFERENCE TO RELATED APPLICATION

This Application is a Section 371 National Stage Application of International Application No. PCT/US2017/049090, filed Aug. 29, 2017 and published, in English, as WO 2018/044871 A1 on Mar. 8, 2018, which claims priority to U.S. Provisional Application No. 62/381,253, filed Aug. 30, 2016. the contents of which are hereby incorporated by reference in their entireties.

BACKGROUND

The present disclosure is directed toward power machines. More particularly, the present disclosure is related to power machines having a lift cylinder and a self-leveling tilt cylinder.

Power machines, for the purposes of this disclosure, include any type of machine that generates power for the purpose of accomplishing a particular task or a variety of tasks. One type of power machine is a work vehicle. Work vehicles, such as telehandlers, are generally self-propelled vehicles that have a work device, such as a lift arm or boom (although some work vehicles can have other work devices) that can be manipulated to perform a work function. In addition to telehandlers, work vehicles include loaders, excavators, utility vehicles, tractors, and trenchers, to name a few examples.

Telehandlers are frequently equipped with self-leveling hydraulic systems to aid in maintaining the fork inclination constant during lifting movement of the boom. In some designs, a tilt load holding valve is used to maintain pressure within the tilt cylinder during operation. Lift capacity of a telehandler is controlled by the lift cylinder dimensions or system pressure. Increasing lift capacity typically requires higher system pressure, for example achieved using larger hydraulic pumps. Alternatively, lift capacity can be increased by increasing dimensions of the lift cylinder. Both options can be costly and may not be preferred for a variety of reasons.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Disclosed embodiments include power machines, control systems and hydraulic circuits which include a lift cylinder, a tilt cylinder, and a slave cylinder mechanically connected to assist the lift cylinder with raising a boom. With a lift control valve controlled to cause extension of the lift cylinder to raise the boom, pressure from a hydraulic source is provided to the base side of a slave cylinder to aid in raising the boom. Resulting increased pressure on the rod side of the slave cylinder opens load holding valves to provide a hydraulic fluid path between the base side of the tilt cylinder and the base side of the slave cylinder, allowing hydraulic pressure from the base side of the tilt cylinder to be communicated to the base side of the slave cylinder such that tilt cylinder pressure due to a heavy load on a fork implement aids in raising the boom.

In some exemplary embodiments, a power machine (300) having a frame (310), a boom (330) pivotally coupled to the frame, a lift cylinder (333) coupled between the frame and the boom to raise and lower the boom, a slave cylinder (337) coupled between the frame and the boom to aid the lift cylinder in raising the boom, an implement interface (352) to which an implement (350) can be mounted, a tilt cylinder (335) coupled between the boom and the implement interface to control rotation of the implement interface and implement relative to the boom, a power source (362) configured to provide pressurized hydraulic fluid, and a control system (360; 400) configured to control provision of the pressurized hydraulic fluid from the power source to the lift cylinder, the slave cylinder and the tilt cylinder. The control system includes a lift control valve (405) coupling the power source to the lift cylinder. The lift control valve has a neutral ("non-actuated") position (410) and first and second actuated positions (407, 408) for extending and retracting the lift cylinder. The control system also includes a tilt control valve (365) having a non-actuated position (428) and first and second actuated positions (425, 426) for extending and retracting the tilt cylinder. In some exemplary embodiments, the control system is further configured such that when the tilt control valve is in the neutral position and the lift control valve is in the first actuated position to extend the lift cylinder, pressurized hydraulic fluid is provided through the lift control valve to the slave cylinder to extend the slave cylinder and aid the lift cylinder in raising the boom, and such that extension of the slave cylinder causes increases in pressure in the tilt cylinder, resulting from a load carried by the implement, to be communicated to the slave cylinder to further aid the lift cylinder in raising the boom.

In some exemplary embodiments, the control system (360; 400) further includes a lift load holding valve (415) coupled between the lift control valve (405) and the lift cylinder (333), and a pressure reducing valve (450) coupled between the lift load holding valve (415) and the slave cylinder (337). The control system (360; 400) is further configured such that when the tilt control valve (365) is in the neutral position (428) and the lift control valve (405) is in the first actuated position (407) to extend the lift cylinder (333), pressurized hydraulic fluid is provided through the lift control valve and through the pressure reducing valve (450) to the slave cylinder (337) to extend the slave cylinder and aid the lift cylinder in raising the boom.

In some exemplary embodiments, the control system (360; 400) further includes a tilt load holding valve (370) coupled between the tilt control valve (365) and the tilt cylinder (335), and a slave load holding valve (460) coupled between the slave cylinder (337) and the tilt cylinder (335). The control system (360; 400) is configured such that when the tilt control valve (365) is in the neutral position (428) and the lift control valve (405) is in the first actuated position (407) to extend the lift cylinder, and pressurized hydraulic fluid is provided through the lift control valve and through the pressure reducing valve (450) to the slave cylinder (337) to extend the slave cylinder, extension of the slave cylinder causes the tilt load holding valve (370) and the slave load holding valve (460) to open and communicate increases in pressure in the tilt cylinder (335), resulting from the load carried by the implement (350), to the slave cylinder to further aid the lift cylinder (333) in raising the boom.

In some exemplary embodiments, the tilt load holding valve (370) is coupled between the tilt control valve (365)

and one of a base side (430) of the tilt cylinder (335) and a rod side (432) of the tilt cylinder. Opening and closing of the tilt load holding valve is controlled by a pressure differential between the base side of the tilt cylinder and the rod side of the tilt cylinder such that the tilt load holding valve aids in self leveling of the tilt cylinder as the lift cylinder (333) is extended or retracted.

In some exemplary embodiments, the slave load holding valve (460) is coupled between one of the base side (430) of the tilt cylinder (335) and the rod side (432) of the tilt cylinder and one of a base side (465) of the slave cylinder (337) and a rod side (467) of the slave cylinder. Opening and closing of the slave load holding valve is controlled by a pressure differential between the base side of the slave cylinder and the rod side of the slave cylinder.

In some exemplary embodiments, the control system (360; 400) is configured such that extension of the slave cylinder (337) causes increases in pressure differentials between the base side (430) of the tilt cylinder (335) and the rod side (432) of the tilt cylinder, and between the base side (465) of the slave cylinder and the rod side (467) of the slave cylinder, thereby opening the tilt load holding valve (370) and the slave load holding valve (460).

In some exemplary embodiments, the control system (360; 400) further includes a check valve (455) positioned between the pressure reducing valve (450) and the slave cylinder (337). The control system is configured to allow pressurized hydraulic fluid to be provided through the lift control valve (405) and through the pressure reducing valve to the slave cylinder, but to prevent pressurized hydraulic fluid from the slave cylinder from being provided to the lift cylinder (333).

In some exemplary embodiments, a method (500) is provided for controlling a power machine having a frame (310), a boom (330) pivotally coupled to the frame, a lift cylinder (333) coupled between the frame and the boom to raise and lower the boom, a slave cylinder (337) coupled between the frame and the boom to aid the lift cylinder in raising the boom, an implement interface (352) to which an implement (350) can be mounted, a tilt cylinder (335) coupled between the boom and the implement interface to control rotation of the implement interface and implement relative to the boom, a power source (362) configured to provide pressurized hydraulic fluid, and a control system (360, 400) configured to control provision of the pressurized hydraulic fluid from the power source to the lift cylinder, the slave cylinder and the tilt cylinder. The control system includes a lift control valve (405) coupling the power source to the lift cylinder and has a non-actuated position (410) and first and second actuated positions (407, 408) for extending and retracting the lift cylinder. The control system also includes a tilt control valve (365) having a non-actuated position (428) and first and second actuated positions (425, 426) for extending and retracting the tilt cylinder. The method includes actuating (505) the lift control valve (405) to the first actuated position (407) to provide pressurized hydraulic fluid through the lift control valve to the lift cylinder (333) to extend the lift cylinder and raise the boom (330). The method also includes identifying (510) a condition of the tilt control valve (365) being in the non-actuated position (428) while the pressurized hydraulic fluid is provided to the lift cylinder (333) and responsively providing (515) pressurized hydraulic fluid through the lift control valve (405) to the slave cylinder (337) to extend the slave cylinder to aid the lift cylinder in raising the boom (330). The method further includes identifying (520) an increase in pressure in the slave cylinder (337) and responsively causing (525) increases in pressure in the tilt cylinder (335), resulting from a load carried by the implement (350), to be communicated to the slave cylinder to further aid the lift cylinder (333) in raising the boom (330).

In some exemplary embodiments, the step of responsively providing (515) pressurized hydraulic fluid through the lift control valve (405) to the slave cylinder (337) to extend the slave cylinder to aid the lift cylinder (333) in raising the boom (330) further includes providing the pressurized hydraulic fluid through the lift control valve and through a pressure reducing valve (450) to the slave cylinder to extend the slave cylinder and aid the lift cylinder in raising the boom.

In some exemplary embodiments, the step of responsively causing (525) increases in pressure in the tilt cylinder (335), resulting from a load carried by the implement (350), to be communicated to the slave cylinder (337) to further aid the lift cylinder (333) in raising the boom further includes opening a tilt load holding valve (370) and a slave load holding valve (460) to allow the increases in pressure in the tilt cylinder to be communicated to the slave cylinder.

DETAILED DESCRIPTION OF ILLUSTRATIVE EMBODIMENTS

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments are directed to power machines, and control systems or hydraulic circuits used thereon, which include a lift cylinder, a tilt cylinder, and a slave cylinder mechanically connected in parallel with the lift cylinder to raise a boom. With a lift control valve controlled to cause extension of the lift cylinder to raise the boom, pressure from a hydraulic source is provided to the base side of a slave cylinder to aid in raising the boom. Resulting increased pressure on the rod side of the slave cylinder opens load holding valves of the tilt and slave cylinders, allowing hydraulic pressure from the base side of the tilt cylinder to be communicated to the base side of the slave cylinder such that tilt cylinder pressure due to a heavy load on a fork implement aids in raising the boom.

These concepts can be practiced on various power machines. A representative power machine on which the embodiments can be practiced is illustrated in diagrammatic form in FIG. 1. For the sake of brevity, only one power machine is discussed. However, the embodiments below can be practiced on any of a number of power machines, including power machines of different types from the representative power machine shown in FIG. 1.

Figure 1:
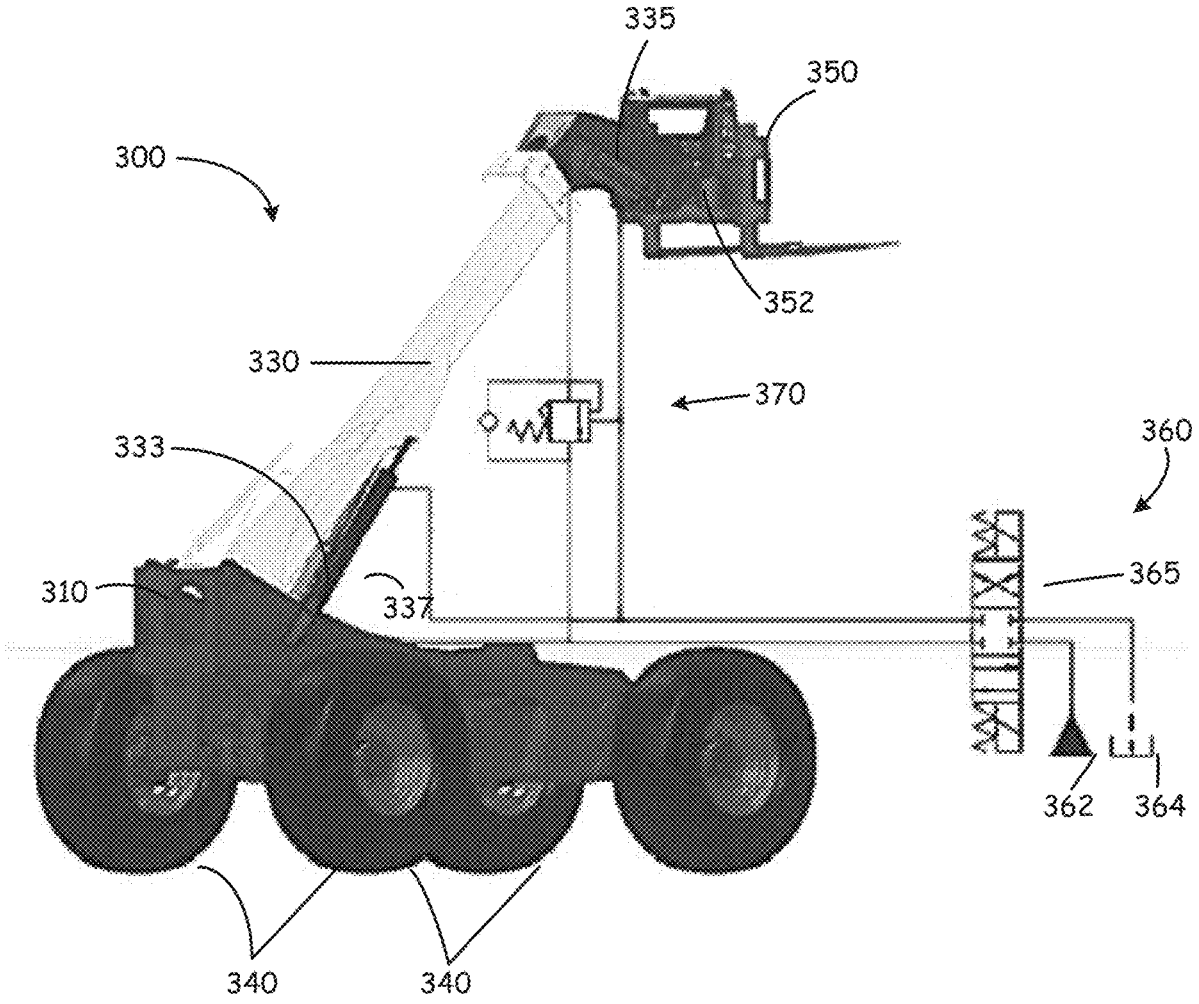
FIG. 1 is a diagrammatic illustration of a power machine having a self-leveling tilt cylinder configuration and including a control system configured to control a slave cylinder to aid in raising a boom.

FIG. 1 is a diagrammatic illustration of a power machine 300, which in the illustrated embodiment is a telehandler. Power machine 300 includes a frame 310 which is supported by attached tractive elements 340. Tractive elements are typically wheels in telehandler type power machines, but can be endless track type tractive elements in other power machines. A boom or arm 330 is pivotably attached at a first end to frame 310, and the boom 330 is raised and lowered under the control of a lift cylinder 333 connected between frame 310 and boom 330. A fork implement 350 is pivotably attached to an implement interface 352 at a second end of boom 330, and the fork implement is rotated relative to boom 330 under the control of a tilt cylinder 335 connected between the fork implement and the boom. A slave cylinder 337 is mechanically coupled between frame 310 and boom 330, either in parallel with lift cylinder 333 or otherwise. Slave cylinder 337 aids in lifting boom 330 under certain conditions as described below.

A control system 360 includes a directional valve 365 which selectively connects a hydraulic source 362 to one of a base side and a rod side of tilt cylinder 335 to control rotation of fork implement 350 relative to boom 330. The directional valve 365 then connects the other of the base side and rod side of tilt cylinder 335 to a return line or tank 364. A load holding valve 370 is connected in-line between the directional valve 365 and the base side of tilt cylinder 335. Slave cylinder 337 can be coupled, along with other components which are not illustrated in FIG. 1, hydraulically in parallel to a portion of the hydraulic circuit including tilt cylinder 335 and load holding valve 370 such that, under certain conditions, hydraulic fluid from the base side of tilt cylinder 335 is provided to the base side of slave cylinder 337 to aid in lifting boom 330. Under other conditions, load holding valve 370 blocks the flow of hydraulic fluid from tilt cylinder 335 to slave cylinder 337. Additional components which aid in controlling the conditions under which slave cylinder 337 receives hydraulic fluid from tilt cylinder 335 are shown and discussed below with reference to FIG. 2.

Figure 2:
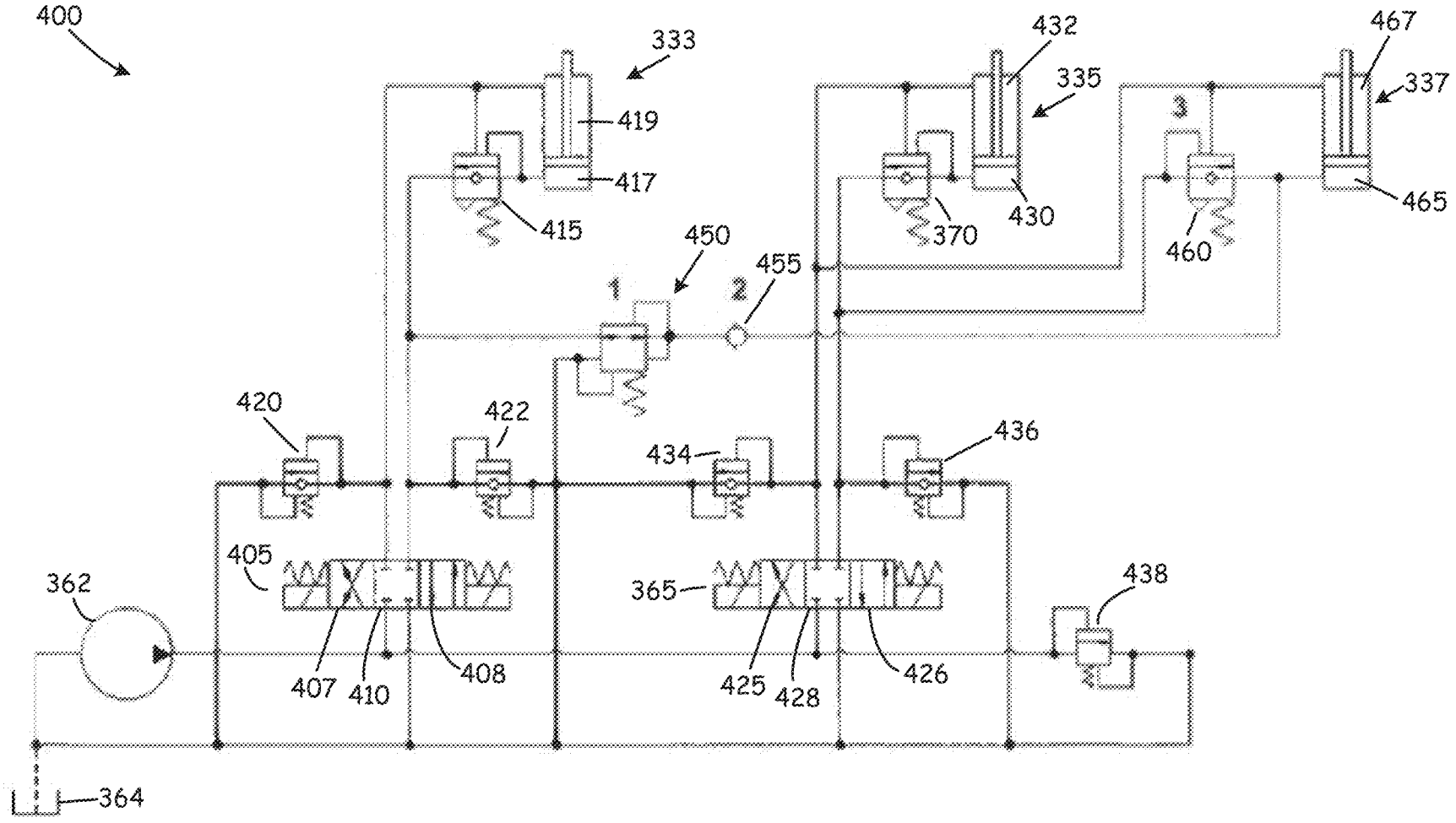
FIG. 2 is a hydraulic circuit diagram illustrating features of the control system of the power machine shown in FIG. 1.

Referring now to FIG. 2, shown is a hydraulic circuit 400 which forms a portion of control system 360 shown in FIG. 1, and which includes additional components for controlling the flow of hydraulic fluid from tilt cylinder 335 to slave cylinder 337 in exemplary embodiments. As shown in FIG. 2, directional lift control valve 405 couples lift cylinder 333 to power source 362, which is illustrated to be a hydraulic pump, and to tank 364 for controlling extension and retraction of lift cylinder 333 to raise and lower boom 330. Lift control valve 405 includes first and second actuated positions 407 and 408, as well as a non-actuated position 410. A pair of pressure relief valves 420 and 422 are coupled between the outputs of lift control valve 405 and tank 364 to relieve or reduce pressures above some threshold pressure in order to protect components of circuit 400. In actuated position 407 of valve 405, base side 417 of lift cylinder 333 is connected to hydraulic fluid from source 362 through a load holding valve 415 to extend lift cylinder 333 and raise the boom, while rod side 419 of lift cylinder 333 is connected to the tank return line. In actuated position 408 of valve 405, rod side 419 of lift cylinder 333 is connected to hydraulic fluid from source 362 and load holding valve 415 couples base side 417 to the tank return line. Thus, as cylinder 333 is retracted to lower the boom, pressure within base side 417 increases, opening load holding valve 415 and allowing hydraulic fluid to flow to tank. In non-actuated position 410 of valve 405, both of the base side 417 and rod side 419 of lift cylinder 333 are disconnected from source 362 and tank 364.

As discussed with reference to FIG. 1, directional lift control valve 365 couples tilt cylinder 335 to power source 362 and tank 364 for controlling extension and retraction of the tilt cylinder to control inclination of fork implement 350. As shown in FIG. 2, tilt control valve 365 includes first and second actuated positions 425 and 426, as well as a non-actuated position 428. A pair of pressure relief valves 434 and 436 are coupled between the outputs of tilt control valve 365 and tank 364 to relieve or reduce pressures above some threshold pressure in order to protect components of circuit 400.

In actuated position 425 of tilt control valve 465, base side 430 of tilt cylinder 335 is connected to hydraulic fluid from source 362 through the load holding valve 370 to extend tilt cylinder 335, while rod side 432 of tilt cylinder 335 is connected to the tank return line. In actuated position 426 of valve 365, rod side 432 of tilt cylinder 335 is connected to hydraulic fluid from source 362 and load holding valve 370 couples base side 430 to the tank return line. Thus, as pressure on rod side 432 increases, pressure within base side 430 also increases, opening load holding valve 370 and allowing hydraulic fluid to flow to tank. In non-actuated position 428 of valve 365, both of the base side 430 and rod side 432 of tilt cylinder 335 are disconnected from source 362 and tank 364. Also shown in FIG. 2, a pressure relief valve 438 is connected between source 362 and tank 364 to protect source 362 from excessive pressure build-up, for example in the event of both of valves 365 and 405 being in their respective non-actuated positions 428 and 410.

In order to facilitate the use of slave cylinder 337 to receive hydraulic fluid from tilt cylinder 335, while also using load holding valve 370 for self-leveling tilt cylinder functions, exemplary embodiments of hydraulic circuit 400 include pressure reducing valve 450, a check valve 455, and a slave cylinder load holding valve 460. Base side 465 of slave cylinder 337 is connected, through slave load holding valve 460 and tilt load holding valve 370, to base side 430 of tilt cylinder 335. Pressure reducing valve 450 is connected to load holding valve 415 and to the output of lift directional valve 405 such that pressure reducing valve 450 receives hydraulic pressure from source 362 when valve 405 is in first actuated position 407 and lift cylinder 333 is being extended to raise boom 330. With tilt control valve 365 in non-actuated position 428 and lift control valve 405 in actuated position 407, pressurized hydraulic fluid from source 362 is provided through load holding valve 415 to base side 417 of lift cylinder 333 to raise boom 350. Pressurized hydraulic fluid is also provided, at a pressure reduced by valve 450, through check valve 455 to base side 465 of slave cylinder 337. With the reduced pressure applied to base side 465, the slave cylinder 337 is extended to aid boom cylinder 333 in lifting heavy loads. As the slave cylinder begins to extend, pressure increases on rod side 467, causing the tilt cylinder load holding valve 370 and the slave cylinder load holding valve 460 to open. Once holding valves 370 and 460 open, forces exerted on the fork implement 350 by a heavy load which cause an increase in pressure on base side 430 of tilt cylinder 335 result in the increased pressure being communicated through load holding valves 370 and 460 to base side 465 of slave cylinder 337. Thus, increased pressures caused by the lifted load are used to help extend slave cylinder 337 and thereby to aid lift cylinder 333 in raising boom 350. Disclosed embodiments thereby increase lifting capacity of boom 330 without increasing the size of lift cylinder 333, increasing the size of the hydraulic pump, etc. During boom lowering, check valve 455 prevents self-leveling hydraulic fluid losses to pressure reducing valve 450.

Figure 3:
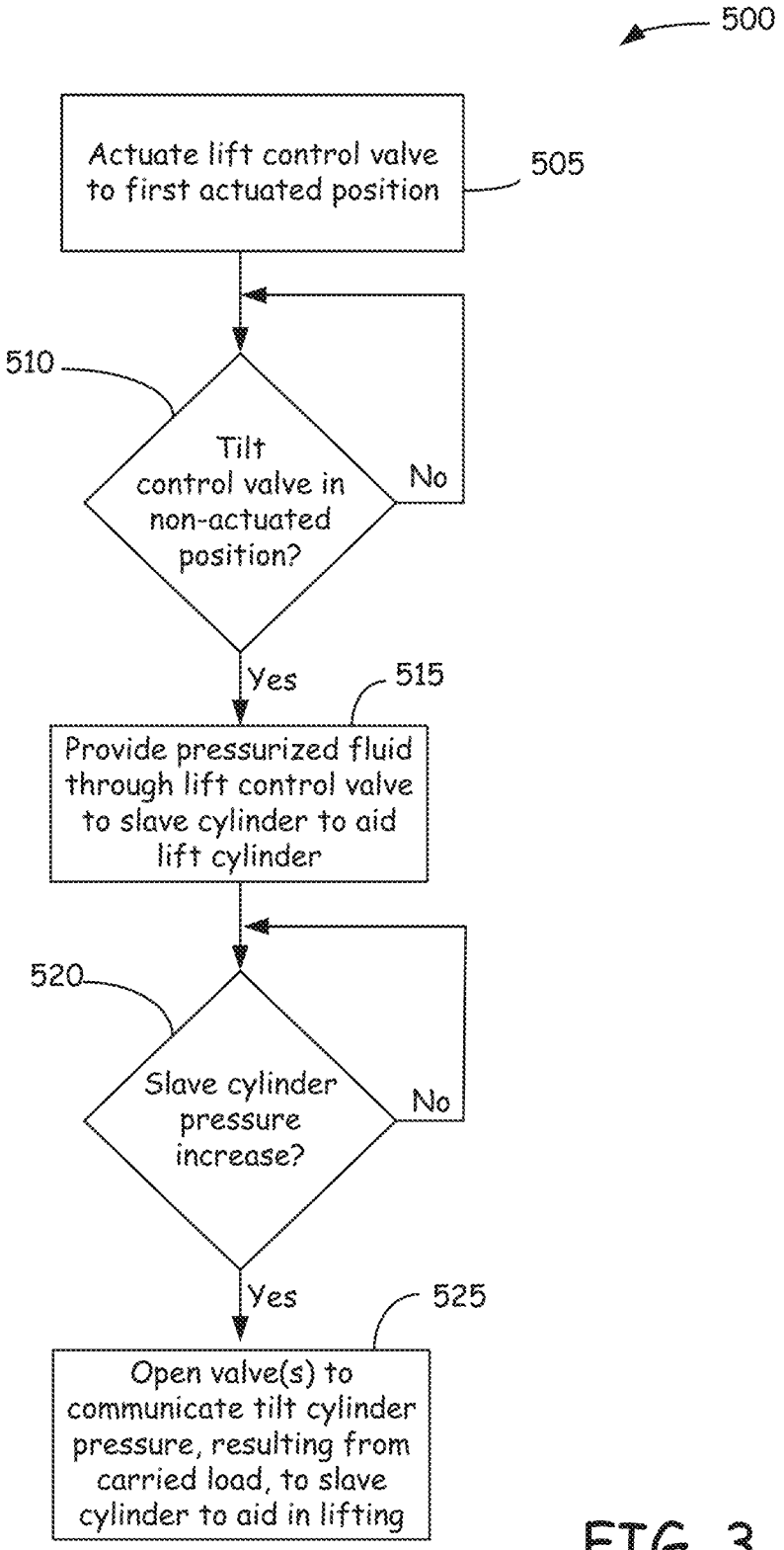
FIG. 3 is a flow diagram illustrating a method of controlling a power machine in accordance with an exemplary embodiment.

The above-described method of controlling a power machine, or the hydraulic control system of a power machine, is illustrated in FIG. 3 in one exemplary embodiment. In method 500 shown in FIG. 3, at sept 505 the lift control valve 405 is actuated to the first actuated position 407. At step 510, identification of a condition in which the tilt control valve is also in the non-actuated position is performed. If the condition of the lift control valve being actuated to the first actuated position and the tilt control valve being in the non-actuated position occurs, pressurized hydraulic fluid is provided through the lift control valve, at step 515, to the slave cylinder to aid in lifting the boom. Then at step 520, increases in pressure within the slave cylinder are identified, and at step 525 valves 370 and 460 are responsively opened to communicate increases in pressure in the tilt cylinder, resulting from a carried load, to the slave cylinder to aid in lifting the boom.

Although the present invention has been described with reference to preferred embodiments, workers skilled in the art will recognize that changes may be made in form and detail without departing from the spirit and scope of the invention. For example, while a particular hydraulic circuit configuration is shown in FIG. 2, those of skill in the art will recognize that disclosed concepts can be practiced in hydraulic circuits using additional components, alternative components and alternative component configurations.

What is claimed is:

1. A power machine having a frame, a boom pivotally coupled to the frame, a lift cylinder coupled between the frame and the boom to raise and lower the boom, a slave cylinder coupled between the frame and the boom to aid the lift cylinder in raising the boom, an implement interface to which an implement can be mounted, a tilt cylinder coupled between the boom and the implement interface to control rotation of the implement interface and implement relative to the boom, a power source configured to provide pressurized hydraulic fluid, and a control system configured to control provision of the pressurized hydraulic fluid from the power source to the lift cylinder, the slave cylinder and the tilt cylinder, the control system including a lift control valve coupling the power source to the lift cylinder and having a non-actuated position and first and second actuated positions for extending and retracting the lift cylinder, a tilt control valve having a non-actuated position and first and second actuated positions for extending and retracting the tilt cylinder;

characterized by the control system being further configured such that:

when the tilt control valve is in the neutral position and the lift control valve is in the first actuated position to extend the lift cylinder, pressurized hydraulic fluid is provided through the lift control valve to the lift cylinder to extend the lift cylinder to raise the boom and through the lift control valve to the slave cylinder to extend the slave cylinder and aid the lift cylinder in raising the boom;

wherein extension of the slave cylinder causes increases in pressure in the tilt cylinder, resulting from a load carried by the implement; and wherein the pressure in the tilt cylinder is communicated to the slave cylinder to further aid the lift cylinder in raising the boom.

2. The power machine of claim 1, wherein the control system further comprises:

a lift load holding valve coupled between the lift control valve and the lift cylinder;

a pressure reducing valve coupled between the lift load holding valve and the slave cylinder;

wherein the control system is configured such that when the tilt control valve is in the neutral position and the lift control valve is in the first actuated position to extend the lift cylinder, pressurized hydraulic fluid is provided through the lift control valve and through the pressure reducing valve to the slave cylinder to extend the slave cylinder and aid the lift cylinder in raising the boom.

3. The power machine of claim 2, wherein the control system further comprises:

a tilt load holding valve coupled between the tilt control valve and the tilt cylinder;

a slave load holding valve coupled between the slave cylinder and the tilt cylinder; and wherein the control system is configured such that when the tilt control valve is in the neutral position and the lift control valve is in the first actuated position to extend the lift cylinder, and pressurized hydraulic fluid is provided through the lift control valve and through the pressure reducing valve to the slave cylinder to extend the slave cylinder, extension of the slave cylinder causes the tilt load holding valve and the slave load holding valve to open and communicate increases in pressure in the tilt cylinder, resulting from the load carried by the implement, to the slave cylinder to further aid the lift cylinder in raising the boom.

4. The power machine of claim 3, wherein the tilt load holding valve is coupled between the tilt control valve and one of a base side of the tilt cylinder and a rod side of the tilt cylinder, and wherein opening and closing of the tilt load holding valve is controlled by a pressure differential between the base side of the tilt cylinder and the rod side of the tilt cylinder such that the tilt load holding valve aids in self leveling of the tilt cylinder as the lift cylinder is extended or retracted.

5. The power machine of claim 4, wherein the slave load holding valve is coupled between one of the base side of the tilt cylinder and the rod side of the tilt cylinder and one of a base side of the slave cylinder and a rod side of the slave cylinder, and wherein opening and closing of the slave load holding valve is controlled by pressure differential between the base side of the slave cylinder and the rod side of the slave cylinder.

6. The power machine of claim 5, wherein the control system is configured such that extension of the slave cylinder causes increases in pressure differentials between the base side of the tilt cylinder and the rod side of the tilt cylinder, and between the base side of the slave cylinder and the rod side of the slave cylinder, thereby opening the tilt load holding valve and the slave load holding valve.

7. The power machine of claim 3, and further comprising a check valve positioned between the pressure reducing valve and the slave cylinder and configured to allow pressurized hydraulic fluid to be provided through the lift control valve and through the pressure reducing valve to the slave cylinder, but to prevent pressurized hydraulic fluid from the slave cylinder from being provided to the lift cylinder.

8. A method of controlling a power machine having a frame, a boom pivotally coupled to the frame, a lift cylinder coupled between the frame and the boom to raise and lower the boom, a slave cylinder coupled between the frame and the boom to aid the lift cylinder in raising the boom, an implement interface to which an implement can be mounted, a tilt cylinder coupled between the boom and the implement interface to control rotation of the implement interface and implement relative to the boom, a power source configured to provide pressurized hydraulic fluid, and a control system configured to control provision of the pressurized hydraulic fluid from the power source to the lift cylinder, the slave cylinder and the tilt cylinder, the control system including a lift control valve coupling the power source to the lift cylinder and having a non-actuated position and first and second actuated positions for extending and retracting the lift cylinder, a tilt control valve having a non-actuated position and first and second actuated positions for extending and retracting the tilt cylinder, the method characterized by steps comprising:

actuating the lift control valve to the first actuated position to provide pressurized hydraulic fluid through the lift control valve to the lift cylinder to extend the lift cylinder and raise the boom;

identifying a condition of the tilt control valve being in the non-actuated position while the pressurized hydraulic fluid is provided through the lift control valve to the lift cylinder and responsively also providing pressurized hydraulic fluid through the lift control valve to the slave cylinder to extend the slave cylinder to aid the lift cylinder in raising the boom; and identifying an increase in pressure in the slave cylinder and responsively causing increases in pressure in the tilt cylinder, resulting from a load carried by the implement, to be communicated to the slave cylinder to further aid the lift cylinder in raising the boom.

9. The method of claim 8, wherein responsively providing pressurized hydraulic fluid through the lift control valve to the slave cylinder to extend the slave cylinder to aid the lift cylinder in raising the boom further comprises providing the pressurized hydraulic fluid through the lift control valve and through a pressure reducing valve to the slave cylinder to extend the slave cylinder and aid the lift cylinder in raising the boom.

10. The method of claim 9, wherein responsively causing increases in pressure in the tilt cylinder, resulting from a load carried by the implement, to be communicated to the slave cylinder to further aid the lift cylinder in raising the boom further comprises opening a tilt load holding valve and a slave load holding valve to allow the increases in pressure in the tilt cylinder to be communicated to the slave cylinder.

11. A power machine having a frame, a boom pivotally coupled to the frame, a lift cylinder coupled between the frame and the boom to raise and lower the boom, a slave cylinder coupled between the frame and the boom to aid the lift cylinder in raising the boom, an implement interface to which an implement can be mounted, a tilt cylinder coupled between the boom and the implement interface to control rotation of the implement interface and implement relative to the boom, a power source configured to provide pressurized hydraulic fluid, and a control system configured to control provision of the pressurized hydraulic fluid from the power source to the lift cylinder, the slave cylinder and the tilt cylinder, the control system including:

a lift control valve coupling the power source to the lift cylinder and having a non-actuated position and first and second actuated positions for extending and retracting the lift cylinder, a tilt control valve having a non-actuated position and first and second actuated positions for extending and retracting the tilt cylinder;

a lift load holding valve coupled between the lift control valve and the lift cylinder;

a pressure reducing valve coupled between the lift load holding valve and the slave cylinder, a tilt load holding valve coupled between the tilt control valve and the tilt cylinder; and a slave load holding valve coupled between the slave cylinder and the tilt cylinder;

wherein the control system is configured such that when the tilt control valve is in the neutral position and the lift control valve is in the first actuated position to extend the lift cylinder, pressurized hydraulic fluid is provided through the lift control valve and through the pressure reducing valve to the slave cylinder to extend the slave cylinder and aid the lift cylinder in raising the boom, and such that the extension of the slave cylinder causes the tilt load holding valve and the slave load holding valve to open and communicate increases in pressure in the tilt cylinder, resulting from the load carried by the implement, to the slave cylinder to further aid the lift cylinder in raising the boom.

12. The power machine of claim 11, wherein the tilt load holding valve is coupled between the tilt control valve and one of a base side of the tilt cylinder and a rod side of the tilt cylinder, and wherein opening and closing of the tilt load holding valve is controlled by a pressure differential between the base side of the tilt cylinder and the rod side of the tilt cylinder such that the tilt load holding valve aids in self leveling of the tilt cylinder as the lift cylinder is extended or retracted.

13. The power machine of claim 12, wherein the slave load holding valve is coupled between one of the base side of the tilt cylinder and the rod side of the tilt cylinder and one of a base side of the slave cylinder and a rod side of the slave cylinder, and wherein opening and closing of the slave load holding valve is controlled by pressure differential between the base side of the slave cylinder and the rod side of the slave cylinder.

14. The power machine of claim 13, wherein the control system is configured such that extension of the slave cylinder causes increases in pressure differentials between the base side of the tilt cylinder and the rod side of the tilt cylinder, and between the base side of the slave cylinder and the rod side of the slave cylinder, thereby opening the tilt load holding valve and the slave load holding valve.

15. The power machine of claim 11, and further comprising a check valve positioned between the pressure reducing valve and the slave cylinder and configured to allow pressurized hydraulic fluid to be provided through the lift control valve and through the pressure reducing valve to the slave cylinder, but to prevent pressurized hydraulic fluid from the slave cylinder from being provided to the lift cylinder.

* * * * *